US010172416B2

(12) United States Patent
Hatfield et al.

(10) Patent No.: US 10,172,416 B2
(45) **Date of Patent: *Jan. 8, 2019**

(54) FLEX GROOVE SOLE ASSEMBLY WITH BIASING STRUCTURE

(71) Applicant: NIKE, Inc., Beaverton, OR (US)

(72) Inventors: Tobie D. Hatfield, Lake Oswego, OR (US); John Hurd, Lake Oswego, OR (US); Dervin A. James, Hillsboro, OR (US); Lee D. Peyton, Tigard, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/622,519

(22) Filed: Jun. 14, 2017

(65) Prior Publication Data

US 2017/0273401 A1 Sep. 28, 2017

Related U.S. Application Data

(60) Continuation of application No. 14/856,998, filed on Sep. 17, 2015, which is a continuation of application (Continued)

(51) Int. Cl.

| | |
|---|---|
| ***A43B 13/18*** | (2006.01) |
| ***A43B 13/14*** | (2006.01) |
| ***A43B 13/16*** | (2006.01) |

(52) U.S. Cl.

CPC ..... *A43B 13/181* (2013.01); *A43B 13/14* (2013.01); *A43B 13/141* (2013.01); *A43B 13/16* (2013.01); *A43B 13/18* (2013.01); *A43B 13/182* (2013.01)

(58) Field of Classification Search

CPC ..... A43B 13/141; A43B 13/16; A43B 13/18; A43B 13/14; A43B 13/008

(Continued)

(56) References Cited

U.S. PATENT DOCUMENTS

| | | | |
|---|---|---|---|
| 1,362,225 | A | 12/1920 | Carlslund |
| 1,964,406 | A | 6/1934 | Pellkofer |

(Continued)

FOREIGN PATENT DOCUMENTS

| | | | |
|---|---|---|---|
| DE | 55619 | C | 3/1891 |
| DE | 297864 | C | 5/1917 |

(Continued)

OTHER PUBLICATIONS

European Patent Office, Communication pursuant to Article 94(3) EPC for European Patent Application No. 11751310.1, dated Jun. 23, 2015.

(Continued)

*Primary Examiner* — Ted Kavanaugh

(74) *Attorney, Agent, or Firm* — Honigman Miller Schwartz and Cohn LLP; Matthew H. Szalach; Jonathan P. O'Brien

(57) ABSTRACT

An article of footwear an upper and a sole structure that defines a first portion and a second portion. The first portion is disposed proximate the medial side of the footwear, and the second portion is disposed proximate the lateral side. The first portion and the second portion are configured to move relative to each other. The article of footwear also includes a flexible biasing member including a first end, a second end, and a middle portion. The middle portion extends across the first portion and the second portion. The first and second ends extend out from the outer surface of the footwear from either the medial or lateral side. The middle portion of the biasing member is configured to bias the first and second portions toward each other.

18 Claims, 8 Drawing Sheets

Related U.S. Application Data

No. 14/284,011, filed on May 21, 2014, now Pat. No. 9,155,353, which is a continuation of application No. 13/932,958, filed on Jul. 1, 2013, now Pat. No. 8,776,400, which is a continuation of application No. 12/717,902, filed on Mar. 4, 2010, now Pat. No. 8,505,220, said application No. 14/284,011 is a continuation of application No. 13/932,988, filed on Jul. 1, 2013, now Pat. No. 8,776,401, which is a division of application No. 12/717,902, filed on Mar. 4, 2010, now Pat. No. 8,505,220.

(58) Field of Classification Search
USPC ..... 36/25 R, 102
See application file for complete search history.

(56) References Cited

U.S. PATENT DOCUMENTS

| | | | |
|---|---|---|---|
| 2,072,785 | A | 3/1937 | Herman |
| 2,206,136 | A | 7/1940 | Tchetchet |
| 2,342,188 | A | 2/1944 | Ghez et al. |
| 2,435,668 | A | 2/1948 | Behringer |
| 2,470,200 | A | 5/1949 | Wallach |
| 2,922,235 | A | 1/1960 | Meltzer |
| 2,992,235 | A | 7/1961 | Green et al. |
| 3,481,332 | A | 12/1969 | Marcia |
| 4,026,045 | A | 5/1977 | Druss |
| 4,309,832 | A | 1/1982 | Hunt |
| 4,331,152 | A | 5/1982 | Bartoli et al. |
| 4,391,048 | A | 7/1983 | Lutz |
| 4,430,810 | A | 2/1984 | Bente |
| 4,562,651 | A | 1/1986 | Frederick et al. |
| 4,922,631 | A | 5/1990 | Anderie |
| 4,936,028 | A | 6/1990 | Posacki |
| 4,941,273 | A | 7/1990 | Gross |
| 5,175,949 | A | 1/1993 | Seidel |
| 5,243,776 | A | 9/1993 | Zelinko |
| 5,560,126 | A | 10/1996 | Meschan et al. |
| 5,729,912 | A | 3/1998 | Gutkowski et al. |
| 5,813,146 | A | 9/1998 | Gutkowski et al. |
| 5,934,599 | A | 8/1999 | Hammerslag |
| 6,055,746 | A | 5/2000 | Lyden et al. |
| 6,115,945 | A | 9/2000 | Ellis, III |
| 6,202,953 | B1 | 3/2001 | Hammerslag |
| 6,247,249 | B1 | 6/2001 | Lindqvist |
| 6,263,593 | B1 | 7/2001 | Pierce et al. |
| 6,289,558 | B1 | 9/2001 | Hammerslag |
| 6,378,230 | B1 | 4/2002 | Rotem et al. |
| 6,990,755 | B2 | 1/2006 | Hatfield et al. |
| 7,143,529 | B2 | 12/2006 | Robinson, Jr. et al. |
| 7,171,767 | B2 | 2/2007 | Hatfield et al. |
| 7,290,357 | B2 | 11/2007 | McDonald et al. |
| 7,392,605 | B2 | 7/2008 | Hatfield et al. |
| 7,510,538 | B2 | 3/2009 | Wolter et al. |
| 7,513,068 | B2 | 4/2009 | Fauver |
| 7,540,100 | B2 | 6/2009 | Pawlus et al. |
| 7,607,241 | B2 | 10/2009 | McDonald et al. |
| 8,505,220 | B2 * | 8/2013 | James ..... A43B 13/141 36/102 |
| 8,776,400 | B2 * | 7/2014 | James ..... A43B 13/141 36/102 |
| 8,776,401 | B2 * | 7/2014 | James ..... A43B 13/141 36/102 |
| 9,155,353 | B2 * | 10/2015 | James ..... A43B 13/141 |
| 9,706,809 | B2 * | 7/2017 | James ..... A43B 13/181 |
| 2002/0095750 | A1 | 7/2002 | Hammerslag |
| 2006/0117600 | A1 | 6/2006 | Greene |
| 2007/0266598 | A1 | 11/2007 | Pawlus et al. |
| 2011/0047816 | A1 | 3/2011 | Nurse |

FOREIGN PATENT DOCUMENTS

| | | | |
|---|---|---|---|
| EP | 0089930 | A1 | 9/1983 |
| WO | WO-9947013 | A1 | 9/1999 |

OTHER PUBLICATIONS

European Supplementary Partial Search Report and Written Opinion for Application No. PCT/US2011/026896, dated Nov. 15, 2013.
International Search Report for Application No. PCT/US2011/026896, dated May 5, 2011.
Office Action dated Oct. 17, 2012 for EP Application No. 11751310.1, filed Sep. 8, 2012.
Written Opinion for Application No. PCT/US2011/026896, dated May 5, 2011.
Office Action dated Jul. 2, 2014 for Chinese Application No. 201180012385.8, filed Sep. 4, 2012.

* cited by examiner

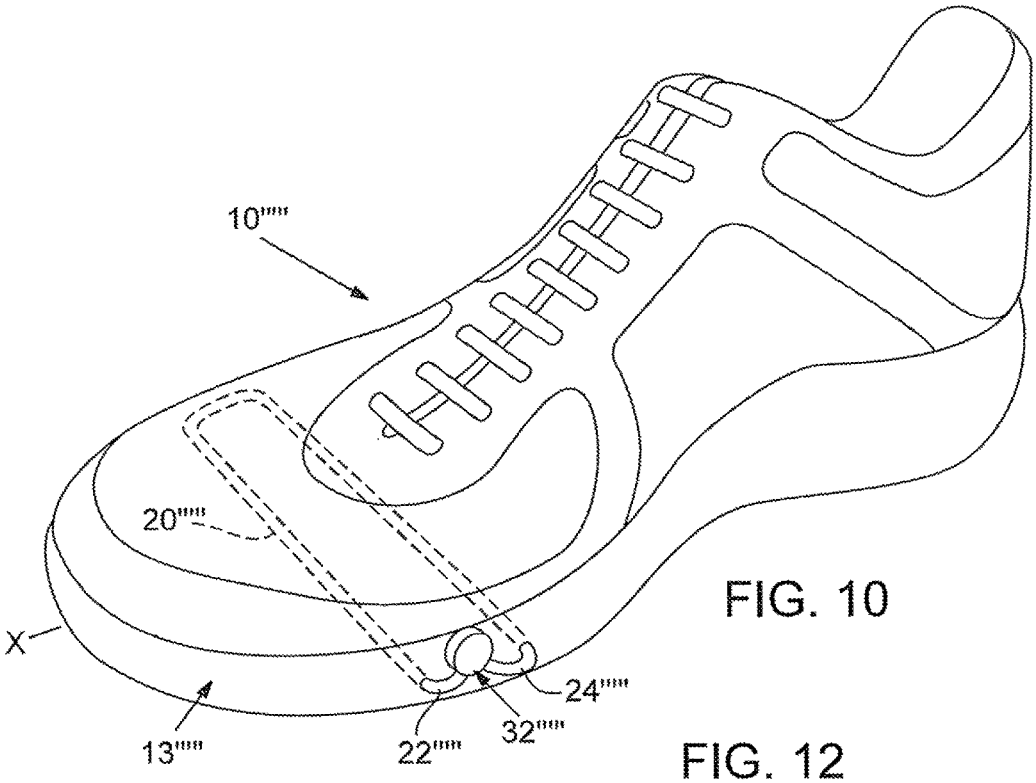
FIG. 10
FIG. 12
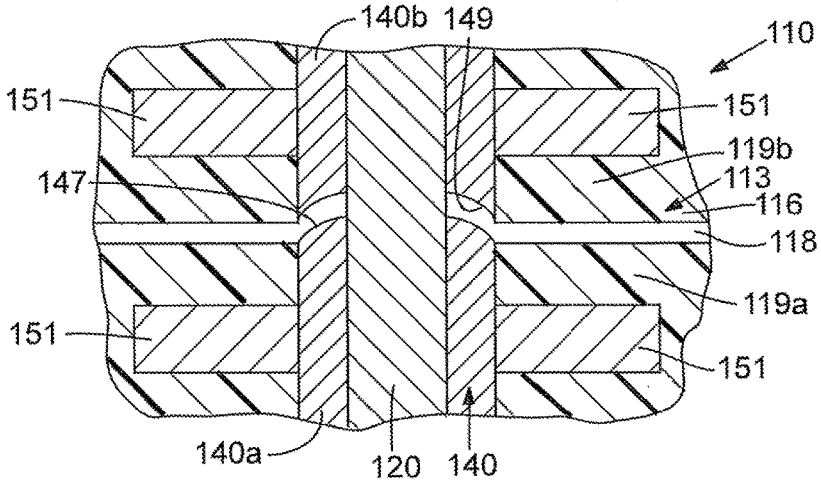

FLEX GROOVE SOLE ASSEMBLY WITH BIASING STRUCTURE

CROSS REFERENCE TO RELATED APPLICATION

This application is a continuation of U.S. patent application Ser. No. 14/856,998, filed Sep. 17, 2015, which is a continuation of U.S. patent application Ser. No. 14/284,011, filed May 21, 2014 (now U.S. Pat. No. 9,155,353). U.S. patent application Ser. No. 14/284,011 (now U.S. Pat. No. 9,155,353) is a continuation of U.S. patent application Ser. No. 13/932,958 (now U.S. Pat. No. 8,776,400), filed Jul. 1, 2013, which is a continuation of U.S. application Ser. No. 12/717,902 (now U.S. Pat. No. 8,505,220), filed Mar. 4, 2010. U.S. patent application Ser. No. 14/284,011 (now U.S. Pat. No. 9,155,353) is also a continuation of U.S. patent application Ser. No. 13/932,988 (now U.S. Pat. No. 8,776,401), filed Jul. 1, 2013, which is a division of U.S. application Ser. No. 12/717,902 (now U.S. Pat. No. 8,505,220). The disclosures of each of the foregoing applications are incorporated by reference in their entirety.

FIELD

The present disclosure relates to footwear and, more particularly, relates to an article of footwear with a flex groove sole assembly and a biasing structure.

BACKGROUND

Articles of footwear usually include an upper and a sole assembly. The upper can include sections of thin material, straps, laces, and the like for covering the wearer's foot and securing the footwear to the wearer. The sole assembly can include an outsole that is typically a unitary piece of relatively durable, high-friction material that provides traction for the footwear. Also, the sole assembly can include a midsole including foam, fluid filled bladder(s), etc. for providing cushioned support for the wearer.

The sole assembly can resiliently deform in response to loads from the wearer. For instance, walking or running can cause the sole assembly to resiliently flex and bend to thereby maintain sufficient surface contact with the ground. The sole assembly can also resiliently deflect in a direction perpendicular to the ground in order to absorb weight loads, thereby cushioning the wearer and providing greater comfort.

In some cases, the sole assembly can include deep grooves (e.g., "flex grooves") or sipes that separate the sole assembly into discrete sole elements and that increase the flexibility of the sole assembly for improved performance. More specifically, the midsole can include one or more grooves with substantially V-shaped cross sections, and the depth of the groove can extend through the majority and/or all of the thickness of the midsole. (See e.g., U.S. Pat. No. 4,562,651, issued Jan. 7, 1986 to Frederick, et al., U.S. Pat. No. 6,055,746, issued May 2, 2000 to Lyden et al., U.S. Pat. No. 6,990,755, issued Jan. 31, 2006 to Hatfield et al., U.S. Pat. No. 7,171,767, issued Feb. 6, 2007 to Hatfield et al., U.S. Pat. No. 7,290,357, issued Nov. 6, 2007 to McDonald et al., U.S. Pat. No. 7,392,605, issued Jul. 1, 2008 to Hatfield et al., and U.S. Pat. 7,607,241, issued Oct. 27, 2009 to McDonald et al., each of which is incorporated herein by reference.) As such, the sole assembly can readily flex and bend about the flex groove, allowing the sole assembly to better conform to the wearer's foot, facilitate flexing during movement of the foot, and the like.

Although conventional sole assemblies have been adequate for their intended purposes, they do suffer from certain disadvantages. For instance, the resiliency and/or flexibility of the midsole may not be suitable for a wide range of activities. More specifically, the midsole may be relatively stiff, and as such, the footwear may be suitable for walking; however, this same midsole might be too stiff for playing tennis, running, or other activities. Accordingly, the usefulness of the footwear may be somewhat limited. On the other hand, the midsole may be highly flexible to be useful for running, playing tennis, and the like; however, this same midsole might be too flexible for other activities in which a stiffer sole provides greater comfort.

Additionally, the sole assembly can wear over time. As such, the midsole may lose resiliency, and the sole assembly may grow more flexible over time, which can be unwanted and undesirable. As a result, the useful life of the footwear may be prematurely shortened. Also, the midsole may develop a curvature over time such that the toe area of the footwear curves upward away from the ground, and the footwear may be less aesthetically pleasing as a result.

SUMMARY

An article of footwear is disclosed that has a medial side, a lateral side, and an outer surface. The article of footwear includes an upper and a sole structure that is operably coupled to the upper. The sole structure defines a first portion and a second portion. The first portion is disposed closer to the medial side than the second portion, and the second portion is disposed closer to the lateral side than the first portion. The first portion and the second portion are configured to move relative to each other. The article of footwear also includes a flexible biasing member including a first end, a second end, and a middle portion. The middle portion extends across the first portion and the second portion. The first end extends out from the outer surface from one of the medial side and the lateral side. The second end extends out from the outer surface from one of the medial side and the lateral side. The middle portion of the biasing member is configured to bias the first and second portions toward each other.

Furthermore, an article of footwear is disclosed that includes an upper and a sole structure that is operably coupled to the upper. The sole structure defines a first portion and a second portion that are separated by an opening. The first portion and the second portion are configured to move relative to each other about the opening. Also, the footwear includes a flexible biasing member with a first section that extends through the sole structure and a second section that extends through the upper. The first section of the biasing member is configured to bias the first portion and the second portion toward each other. The second section of the biasing member is at least partially enclosed by the upper.

Furthermore, an article of footwear is disclosed that includes an upper and a sole structure that is operably coupled to the upper. The sole structure defines a ground engaging surface. The sole structure defines a first portion and a second portion that are separated by an opening. The opening is open to the ground engaging surface. The first portion includes a recess, and the second portion includes a projection that is received within the recess to guide rotation of the second portion relative to the first portion. Also, the article of footwear includes a flexible biasing member that is attached to the first portion and the second portion of the sole structure. The flexible biasing member biases the second portion in rotation relative to the first portion. Additionally, the biasing member is exposed from the sole structure.

This section provides a general summary of the disclosure, and is not a comprehensive disclosure of its full scope or all of its features. Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

FIGS. 6-11 are perspective views of the article of footwear according to various other exemplary embodiments of the present disclosure;

FIG. 12 is a cross sectional view of a portion of the article of footwear according to another exemplary embodiment of the present disclosure;

Corresponding reference numerals indicate corresponding parts throughout the several views of the drawings.

DETAILED DESCRIPTION

Figure 1:
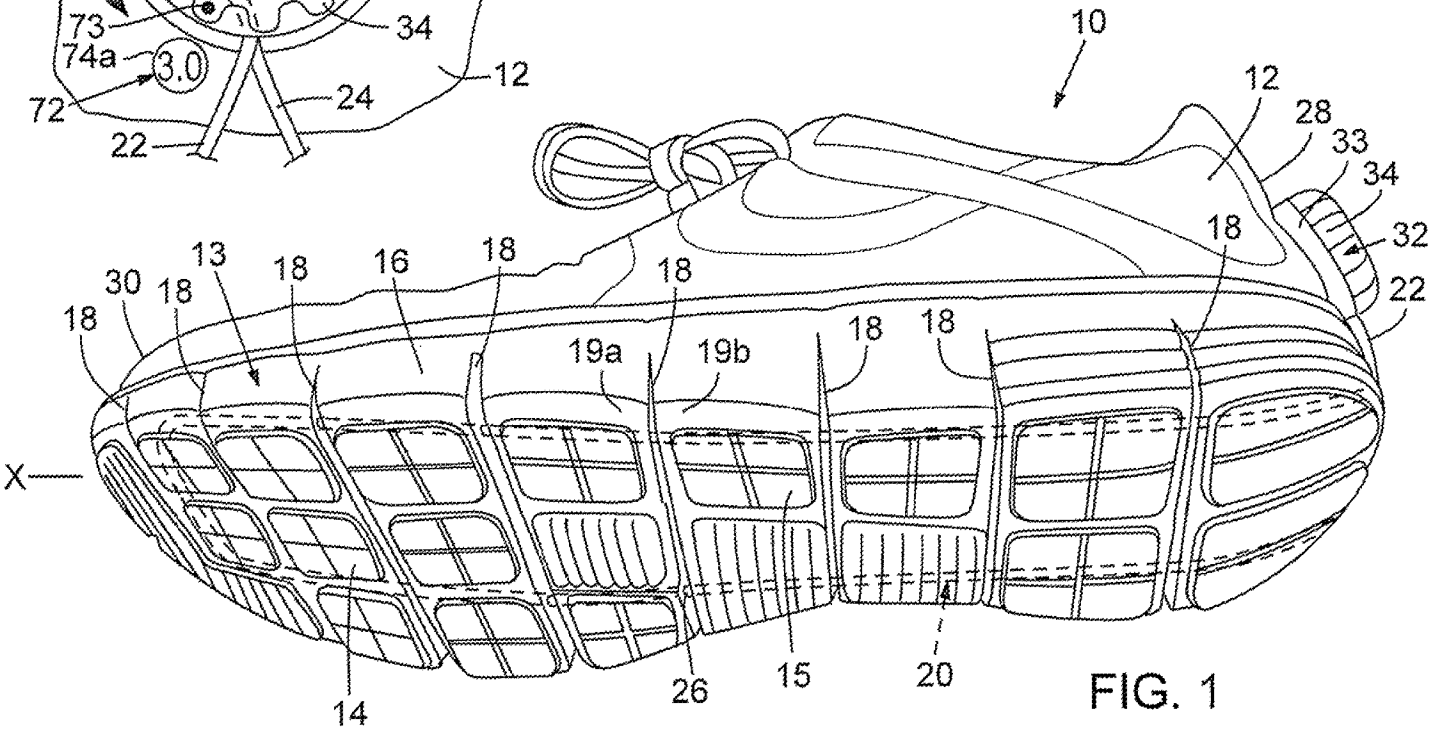
FIG. 1 is a perspective view of an article of footwear according to various exemplary embodiments of the present disclosure.

Example embodiments will now be described more fully with reference to the accompanying drawings.

Referring initially to FIGS. 1-4, an exemplary embodiment of an article of footwear 10 is illustrated according to various teachings of the present disclosure. Generally, the article of footwear 10 includes an upper 12 and a sole assembly 13. The sole assembly 13 is operatively coupled to the upper 12 and can include an outsole 14 and a midsole 16. Although the article of footwear 10 is illustrated as an athletic shoe, it will be appreciated that the footwear 10 could be a boot, a sandal, or any other type without departing from the scope of the present disclosure.

In some embodiments, the upper 12 can include various thin sheets of material that partially overlap each other and that are operably secured to each other, for example, by stitching, adhesives, and the like. The upper 12 can also include a fastening structure, such as laces, buckles, pile tape, and/or other features for tightly securing the upper 12 to the wearer's foot. It will also be appreciated that the upper 12 can include various decorative features for aesthetically enhancing the footwear 10.

Also, the outsole 14 can include a layer of high-friction material for providing traction. The outsole 14 can define a ground-engaging surface 15. The ground-engaging surface 15 can include a predetermined pattern of ridges, recesses, bumps, and the like for further increasing traction. The outsole 14 can be secured to the midsole 16 and/or the upper 12 in any suitable fashion, such as adhesives. In other embodiments, the outsole 14 includes a plurality of individual pads that are attached to the midsole 16 such that both the outsole 14 and midsole cooperate to define the ground-engaging surface 15. In this latter embodiment, the individual pads of the outsole 14 can be disposed at locations that are prone to increased wear.

Moreover, the midsole 16 can be coupled to and disposed between the upper 12 and the outsole 14. The midsole 16 can include a flexible, resilient foam material that is disposed between the outsole 14 and the upper 12. The midsole 16 can also include one or more embedded, fluid-filled bladders (not shown). Accordingly, the midsole 16 can provide substantial cushioning for the wearer.

The sole assembly 13 can include one or more grooves 18 that increase the flexibility of the sole assembly 13. More specifically, each groove 18 can separate the sole assembly 13 into separate, distinct portions 19*a*, 19*b*, and the portions 19*a*, 19*b* are able to move relative to each other due to the respective groove(s) 18 therebetween. The term "groove", herein, will be understood to include grooves, sipes, slits, channels, openings, passages, and the like, regardless of the method of manufacture (e.g., molded into the sole assembly 13, cut into the sole assembly 13, etc.).

The grooves 18 can incorporate one or more features of a flex groove or sipe pattern of the type disclosed in U.S. Pat. No. 4,562,651, issued Jan. 7, 1986 to Frederick, et al., U.S. Pat. No. 6,055,746, issued May 2, 2000 to Lyden et al., U.S. Pat. No. 6,990,755, issued Jan. 31, 2006 to Hatfield et al., U.S. Pat. No. 7,171,767, issued Feb. 6, 2007 to Hatfield et al., U.S. Pat. No. 7,290,357, issued Nov. 6, 2007 to McDonald et al., U.S. Pat. No. 7,392,605, issued Jul. 1, 2008 to Hatfield et al., and U.S. Pat. 7,607,241, issued Oct. 27, 2009 to McDonald et al., each of which is incorporated herein by reference. However, it will be appreciated that the grooves 18 can have any suitable geometry and can be disposed at any suitable location on the footwear 10.

Figure 2:
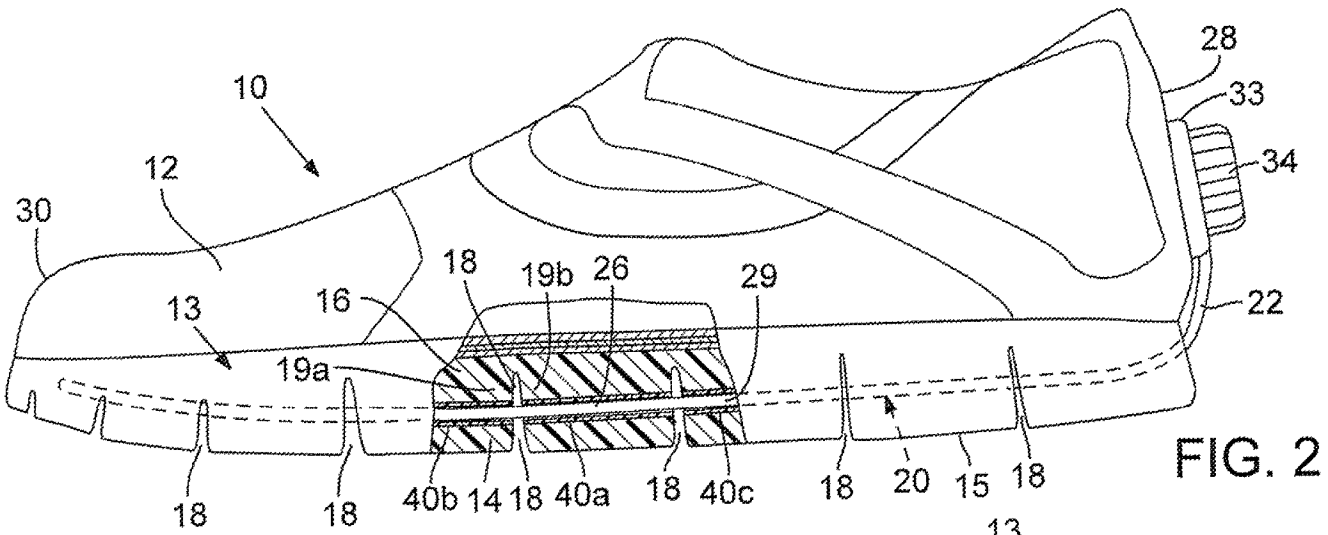
FIG. 2 is a side view and partial section view of the article of footwear of FIG. 1.
Figure 4:
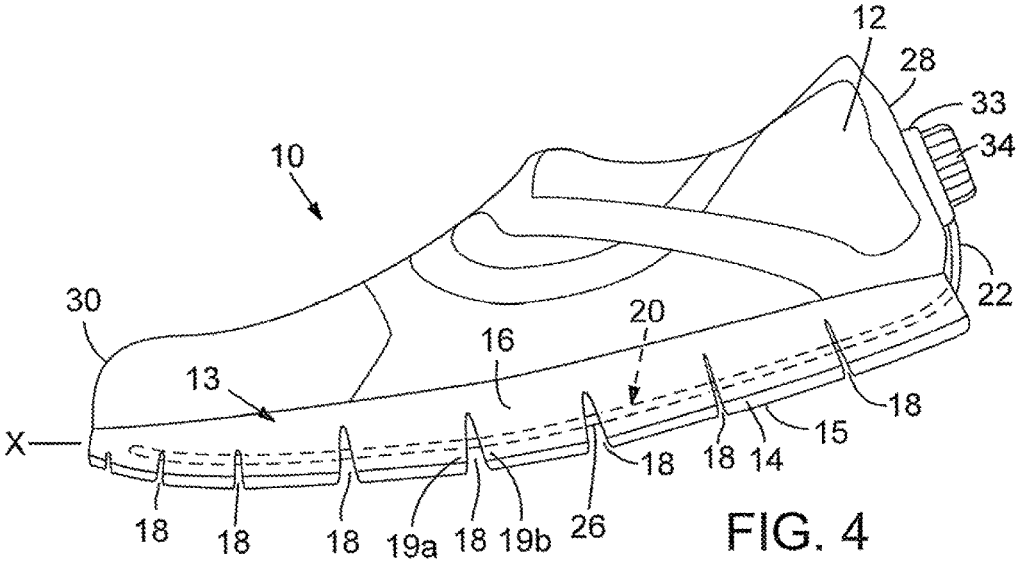
FIG. 4 is a side view of the article of footwear of FIG. 1.

The grooves 18 can each extend through the sole assembly 13 in a depth direction generally perpendicular to the ground-engaging surface 15 as shown in FIGS. 1, 2, and 4. The grooves 18 can have any suitable depth within the sole assembly 13, and the depth direction of the grooves 18 can be at a positive, acute angle relative to the ground-engaging surface 15. The grooves 18 can be open at the ground-engaging surface 15; however, it will be appreciated that the grooves 18 can be closed at the ground-engaging surface 15. Also, one or more of the grooves 18 can extend entirely through the outsole 14 and partially through the midsole 16 (e.g., through the majority of the midsole 16). In some embodiments, the grooves 18 can extend only through the midsole 16. In addition, the depth of the grooves 18 can vary throughout the sole assembly 13.

Furthermore, the grooves 18 can each be axially straight, the grooves 18 can be substantially parallel to each other, and the longitudinal axis of the grooves 18 can extend substantially perpendicular to a longitudinal axis X of the footwear. The grooves 18 can be spaced apart at any suitable distance. It will be appreciated that the grooves 18 can each have a longitudinal axis that extends in any suitable direction. For instance, the grooves 18 can extend parallel or at an acute angle relative to the axis X. Moreover, it will be appreciated that the grooves 18 can each have a non-linear axis. For instance, one or more of the grooves 18 can have a curved or wavy (e.g., generally sinusoidal) longitudinal axis. In addition, the grooves 18 can be continuous (e.g., ring-shaped).

Moreover, as shown in FIGS. 1, 2, and 4, the grooves 18 can each have a substantially V-shaped cross section and can have a relatively small width when the sole assembly 13 is at rest (FIG. 2). In some embodiments, the width of the grooves 18 can be so small that the first and second portions 19*a*, 19*b* abut at least partially against each other when the sole assembly 13 is at rest. When the sole assembly 13 is flexed (FIG. 4), the width of the grooves 18 increases, and the portions 19*a*, 19*b* move away from each other as will be discussed.

It will be appreciated that the article of footwear 10 can include any suitable number of grooves 18 on any suitable location of the sole assembly 13. Moreover, the sole assembly 13 may not include any grooves 18, and the article of footwear 10 would remain within scope of the present disclosure.

Additionally, it will be appreciated that the grooves 18 can substantially increase flexibility of the sole assembly 13. For instance, the grooves 18 can allow the portions 19*a*, 19*b* to hingeably rotate about the respective longitudinal axis of the respective groove 18 for increased flexibility of the sole assembly 13. Furthermore, in some embodiments, the location of the grooves 18 can correspond to natural, anatomical points of flexure of the wearer's foot. As such, the grooves 18 can promote natural flexure of the wearer's foot for greater comfort and performance.

Furthermore, the article of footwear 10 can include a biasing structure 20. The biasing structure can bias the portions 19*a*, 19*b* of the sole assembly 13 toward each other in a manner to be described in greater detail below. More specifically, the tension in the biasing structure 20 can affect (i.e., limit) the stiffness and flexibility of the sole assembly 13 as will be discussed.

The biasing structure 20 can be a resiliently extendable, flexible, and elastic elongate cord. The biasing structure 20 can also include woven elastic strands, such as a bungee cord. However, it will be appreciated that the biasing structure 20 can be nonextendable and nonresilient, such as a braided metallic cord, thread, or wire. In still other embodiments, the biasing structure 20 can include portions that are resiliently extendable and other portions that are nonextendable. For instance, the biasing structure 20 can include a relatively resiliently extendable portion at a first longitudinal location along its axis and another relatively nonextendable portion at a second longitudinal location along its axis. The biasing structure 20 can be bendable so as to be routed along any suitable location on the footwear 10. It will be appreciated that the biasing structure 10 can have any suitable shape and can include any suitable material.

Figure 3:
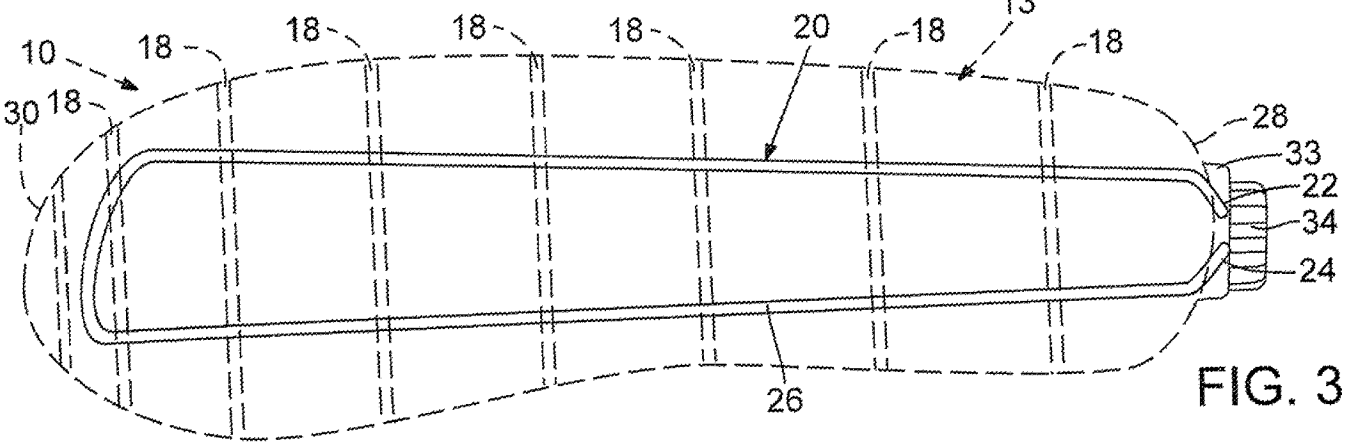
FIG. 3 is a bottom view of the article of footwear of FIG. 1.

The biasing structure 20 can include a first end 22 and a second end 24 (FIG. 3). The biasing structure 20 can further include a middle portion 26 that extends between the first and second ends 22, 24. The middle portion 26 can extend through and can be operably coupled to the sole assembly 13, and the first and second ends 22, 24 can extend out of a posterior portion 28 of the sole assembly 13 to be operably secured to the upper 12 and/or the sole assembly 13. More specifically, the middle portion 26 can extend through the midsole 16, through an elongate passage 29 defined therein. As such, the middle portion 26 can be enclosed and contained within the passage 29 and directly coupled to the midsole 16. The elongate passage 29 and the middle portion 26 can have similar dimensions such that the middle portion 26 fits snugly within the passage 29.

Also, the sole assembly 13 can include one or more reinforcing tubes 40*a*, 40*b*, 40*c* as shown in FIG. 2. The reinforcing tubes 40*a*, 40*b*, 40*c* can be made out of polymeric tubing. The reinforcing tubes 40*a*, 40*b*, 40*c* can extend through the midsole 16 and can be fixed thereto. For instance, the reinforcing tubes 40*a*, 40*b*, 40*c* can be fixedly embedded within the midsole 16 via a molding process. The reinforcing tubes 40*a*, 40*b*, 40*c* may or may not extend across the grooves 18. For instance, as shown in the exemplary embodiment shown in FIG. 2, reinforcing tube 40*a* can be embedded the first portion 19*a* of the sole assembly 13, and the reinforcing tube 40*b* can be embedded within the second portion 19*b* of the sole assembly 13. The biasing structure 20 can extend across and within the groove 18 and can be received in each of the tubes 40*a*, 40*b*. Accordingly, the tubes 40*a*, 40*b* can define the passage 29 through which the biasing structure 20 is threaded. The tube 40*c* and any additional tubes can similarly receive other axial portions of the biasing structure 20 in order to operably secure the biasing structure 20 to the sole assembly 13. It will be understood that the footwear 10 can include any number of tubes 40*a*, 40*b*, 40*c* along the axial length of the biasing structure 20. Moreover, it will be appreciated that the footwear 10 can include a single, continuous reinforcing tube 40*a* that extends continously along the majority of the axial length of the biasing structure 20.

As such, the reinforcing tubes 40*a*, 40*b*, 40*c* can reinforce the material of the midsole 16, thereby inhibiting wear of the sole assembly 13 otherwise caused by friction between the biasing structure 20 and the material of the midsole 16. Also, the biasing structure 20 can be loosely and/or slidably received within the reinforcing tubes 40*a*, 40*b*, 40*c* such that the biasing structure 20 can move within the reinforcing tubes 40*a*, 40*b*, 40*c* when tension in the biasing structure 20 is adjusted as described in greater detail below. Furthermore, the coefficients of friction can be relatively low between the biasing structure 20 and the reinforcing tubes 40*a*, 40*b*, 40*c* such that the biasing structure 20 can slide in the tubes 40*a*, 40*b*, 40*c* with relatively little resistance. In addition, the tubes 40*a*, 40*b*, 40*c* can distribute forces from the biasing structure 20 across a wider surface area of the midsole 16 such that the midsole 16 is less likely to be cut by the biasing structure 20.

It will be appreciated that the reinforcing tubes 40*a*, 40*b*, 40*c* are optional components of the footwear 10 of the present disclosure. In some embodiments, for instance, the tubes 40*a*, 40*b*, 40*c* are not included, and the biasing structure 20 is received directly in the material of the sole assembly 13. Also, in some embodiments, the biasing structure 20 is fixed directly to the material of the sole assembly 13 (e.g., via adhesives, via a molding process, and the like).

In the exemplary embodiment of FIGS. 1-4, the middle portion 26 of the biasing structure 20 can extend axially from the posterior portion 28 toward an anterior portion 30, and the middle portion 26 (and the passage 29) can have an approximately one hundred eighty degree (180°) turn adjacent the anterior portion 30 to curve back toward the posterior portion 28. The middle portion 26 can turn back toward the posterior portion 28 at any suitable radius. As such, both first and second ends 22, 24 can extend out of the posterior portion 28 and can be spaced apart from each other on opposite sides of the axis X. However, it will be appreciated that the biasing structure 20 can extend through any portion of the sole assembly 13 or any other portion of the footwear. Also, it will be appreciated that one or more of the ends 22, 24 can be disposed within the sole assembly 13 without departing from the scope of the present disclosure.

Figure 11:
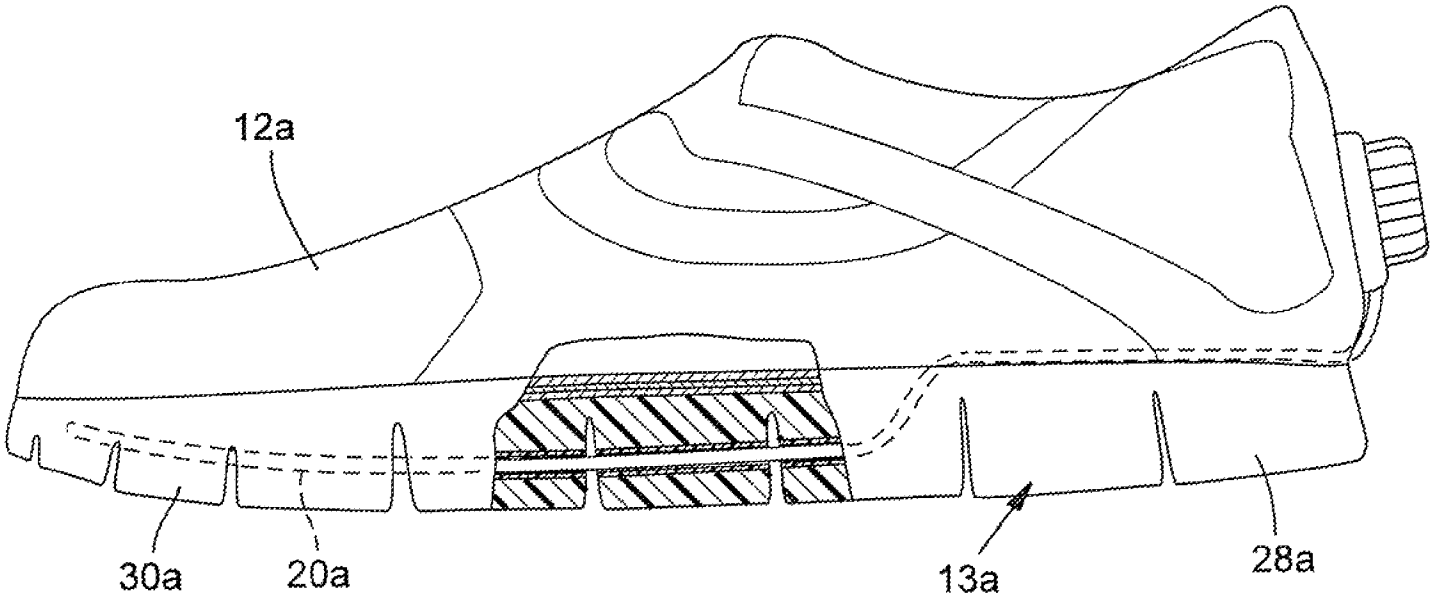

In addition, it will be appreciated that any portion of the biasing structure 20 can be disposed in or on the upper 12 without departing from the scope of the present disclosure. For instance, as shown in the embodiment shown in FIG. 11, the biasing structure 20*a* can be partially attached (e.g., embedded) within the sole assembly 13*a* and can also be partially attached (e.g., embedded and/or enclosed) within the upper 12*a*. For instance, the biasing structure 20*a* can extend through the anterior portion 30*a* of the sole assembly 13*a*, and the biasing structure 20*a* can also extend through the upper 12*a* adjacent the posterior portion 28*a*. Accordingly, the biasing structure 20*a* can affect the stiffness in a localized portion of the sole assembly 13*a* (i.e., within the anterior portion 30*a*) without significantly affecting the stiffness of the sole assembly 13*a* in the posterior portion 28*a*. Also, the biasing structure 20*a* can be routed through both the sole assembly 13*a* and the upper 12*a* in order to bias the sole assembly 13*a* and the upper 12*a* towards each other. Moreover, the biasing structure 20*a* can be routed through the upper 12*a* for selectively adjusting stiffness (i.e., tuning) select portions of the upper 12*a*.

Furthermore, the middle portion 26 can extend substantially parallel to the ground-engaging surface 15. However, it will be appreciated that the middle portion 26 can extend at an acute angle relative to the ground-engaging surface 15. For instance, in some exemplary embodiments, the axis of the middle portion 26 can extend in a zig-zagging direction toward and away from the ground-engaging surface 15. Also, the middle portion 26 can extend through the midsole 16 and can be spaced apart from the outsole 14. However, it will be appreciated that the middle portion 26 can extend through the midsole 16 and/or the outsole 14.

Moreover, the biasing structure 20 can extend across one or more of the grooves 18. As such, the biasing structure 20 can extend between the individual portions 19*a*, 19*b* of the sole assembly 13.

It will be appreciated that the biasing structure 20 can apply a biasing force to the sole assembly 13. More specifically, the biasing structure 20 can bias the portions 19*a*, 19*b* of the sole assembly 13 toward each other to thereby limit and reduce the flexibility of the sole assembly 13.

Moreover, the article of footwear 10 can include an adjustment device, generally indicated at 32. The first and second ends 22, 24 of the biasing structure 20 can be operably coupled to the adjustment device 32 such that the adjustment device 32 can be used to adjust an amount of biasing force that the biasing structure 20 applies to the sole assembly 13. More specifically, the adjustment device 32 can adjust tension in the biasing structure 20 as discussed in greater detail below. The adjustment device 32 can allow for manual adjustment of the biasing force applied by the biasing structure 20, and/or the adjustment device 32 can allow for automatic adjustment of the biasing force. The adjustment device 32 can incorporate one or more features disclosed in U.S. Pat. Nos. 5,934,599, 6,202,953, and/or 6,289,558, each to Hammerslag, each of which is incorporated herein by reference in its entirety.

The adjustment device 32 can include a base 33, which can be made from rigid polymeric material. The base 33 can be fixed to the posterior portion 28, to the upper 12 and/or the sole assembly 13. The adjustment device 32 can also include a spool 34, which can be made of rigid polymeric material. The spool 34 can be rotatably coupled to the base 33, and the first end 22 and/or the second end 24 of the biasing structure 20 can be spooled on the spool 34. For instance, in some embodiments, the first end 22 can be fixed to the base 33 while the second end 24 spools on the spool 34. In another embodiment, both ends 22, 24 spool and unspool on the spool 34.

Rotation of the spool 34 in one direction relative to the base 33 can spool the second end 24, pull the second end 24 longitudinally away from the first end 22, and increase tension (i.e., biasing force) in the biasing structure 20. Accordingly, the biasing structure 20 draws the portions 19*a*, 19*b* of the sole assembly 13 toward each other and increase stiffness in the sole assembly 13. On the other hand, rotation of the spool 34 in the opposite direction can unspool the second end 24 from the spool 34, thereby reducing tension (i.e., biasing force) in the biasing structure 20. Accordingly, the biasing structure 20 allows the portions 19*a*, 19*b* to move away from each other and decreases stiffness in the sole assembly 13.

Figure 5:
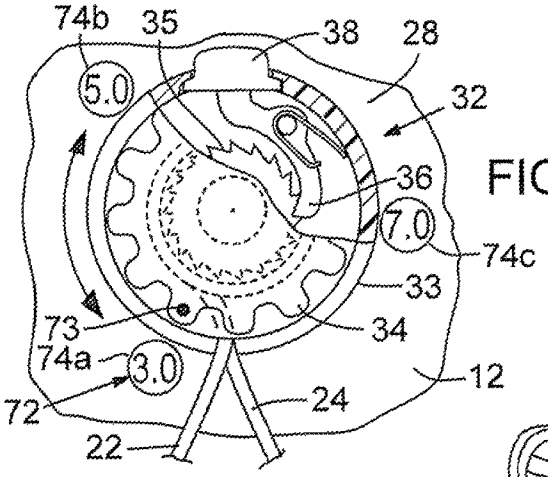
FIG. 5 is a rear view of the article of footwear.

As shown in FIG. 5, the adjustment device 32 can also include a plurality of notches 35. The notches 35 can be included on the spool 34, between the spool 34 and the base 33. Furthermore, the adjustment device 32 can also include a catch 36. The catch 36 can be moveably coupled to the base 33, and the catch 36 can be selectively received within one or more of the notches 35 to inhibit rotation of the spool 34. Additionally, the adjustment device 32 can include a release 38, such as button, lever, or the like. The release 38 can be operably coupled to the catch 36 for moving the catch 36 in and/or out of the notches 35. Furthermore, the spool 34 can be biased for rotation in one direction (e.g., in the direction that causes unspooling of the end(s) 22, 24 of the biasing structure 20). Moreover, the catch 36 can be biased toward the notches 35.

Accordingly, if the wearer desires to tighten up the sole assembly 13 (i.e., to increase biasing of the portions 19*a*, 19*b* toward each other), the user can manipulate the release 38 to move the catch 36 out of the notch(es) 35, and the wearer can manually rotate the spool 34 in one direction to further spool the ends 22, 24 of the biasing structure 20 on the spool 34. Then, the catch 36 can be received in one or more of the notches 35 to substantially lock the spool 34 against rotation and to retain the biasing structure 20 at the set level of biasing.

If the wearer desires to loosen the sole assembly 13 (i.e., to decrease biasing of the portions 19*a*, 19*b* toward each other), the wearer can manipulate the release 38 to allow the spool 34 to rotate in the opposite direction. Then, the catch 36 can be received in one or more of the notches 35 to substantially lock the spool 34 against rotation and to retain the biasing structure 20 at the set level of biasing.

It will be appreciated that the adjustment device 32 can be of any suitable type other than the type shown in FIG. 5. In other embodiments, the adjustment device 32 can include a slider which the user can manipulate to adjust the level of stiffness of the footwear 10.

Still further, as shown in FIG. 5, the adjustment device 32 can include an indicator system 72 that indicates the stiffness of the sole assembly 13 that has been set by the wearer. The indicator system 72 can be a visual indicator system, an audible indicator system, a tactile indicator system, or any other suitable type. As shown in FIG. 5, the indicator system 72 can include a first indicator 73 and a plurality of second indicators 74*a*, 74*b*, 74*c*. The first indicator 73 can be a dot or other shape that is located on the spool 34, and the second indicators 74*a*, 74*b*, 74*c* can be numbers or other symbols that are spaced evenly about the spool 34 on the upper 12. The second indicators 74*a*, 74*b*, 74*c* can correspond to individual, predetermined biasing levels (i.e., stiffness levels) for the sole assembly 13. Thus, when the first indicator 73 is rotated to be aligned with the second indicator 74*a*, the sole assembly 13 can be at a first predetermined level of stiffness due to the set level of tension in the biasing structure 20. Also, when the first indicator 73 is rotated to be aligned with the other second indicators 74*b*, 74*c*, the sole assembly 13 can be at different levels of stiffness. Accordingly, the indicator system 72 can allow the user to conveniently and accurately set the stiffness of the sole assembly 13 to these predetermined stiffness levels.

It will be appreciated that the indicator system 72 can be of any suitable type. For instance, if the indicator system 72 is an audible indicator system 72, the indicator system 72 can provide a predetermined noise (e.g., a predetermined number of audible clicks) corresponding to a predetermined level of stiffness.

Also, it will be appreciated that, because the biasing structure 20 extends primarily in the anterior/posterior direction, the biasing structure 20 can adjust stiffness of the sole assembly 13 primarily in the anterior/posterior direction. However, it will be appreciated that the biasing structure 20 can be disposed on any suitable portion of the footwear 10 for adjusting stiffness of a corresponding portion of the footwear 10. As such, the biasing structure 20 can be routed through a localized region of the footwear 10 for adjusting stiffness at that corresponding region.

Figure 6:
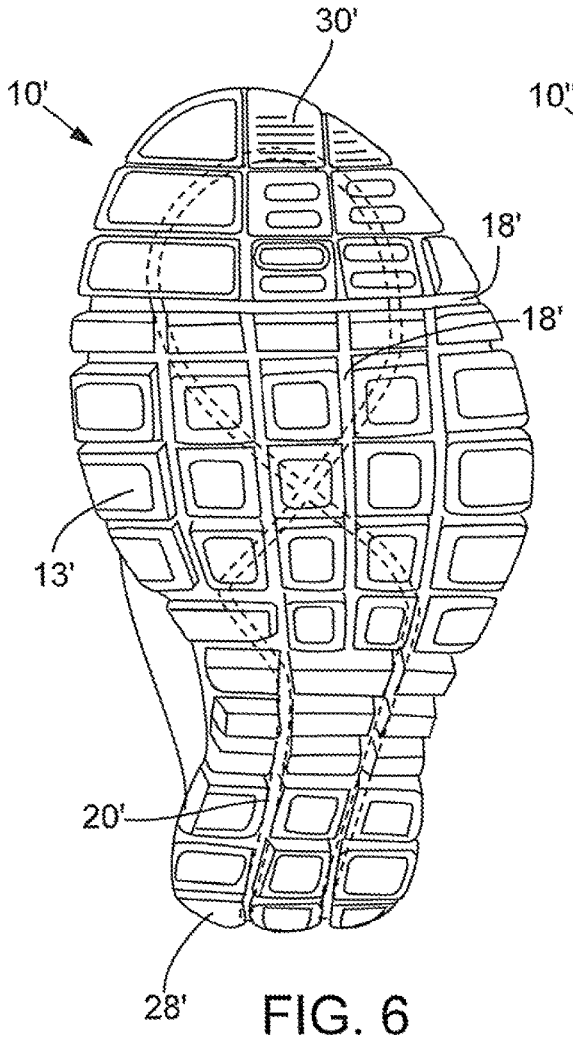

For instance, as shown in the embodiment of FIG. 6, the biasing structure 20' can extend from the posterior portion 28' to the anterior portion 30' of the footwear 10', and the biasing structure 20' can also loop over itself adjacent the anterior portion 30'. Thus, by adjusting the biasing structure 20' as discussed above, the stiffness of the sole assembly 13' can be adjusted. More specifically, the stiffness of the sole assembly 13' in both the anterior/posterior and medial/lateral directions can be adjusted. Moreover, the grooves 18' can extend in a medial/lateral direction as well as in the anterior/posterior direction such that the biasing structure 20' can adjust the stiffness of the sole assembly 13' in both the anterior/posterior and medial/lateral directions.

Figure 7:
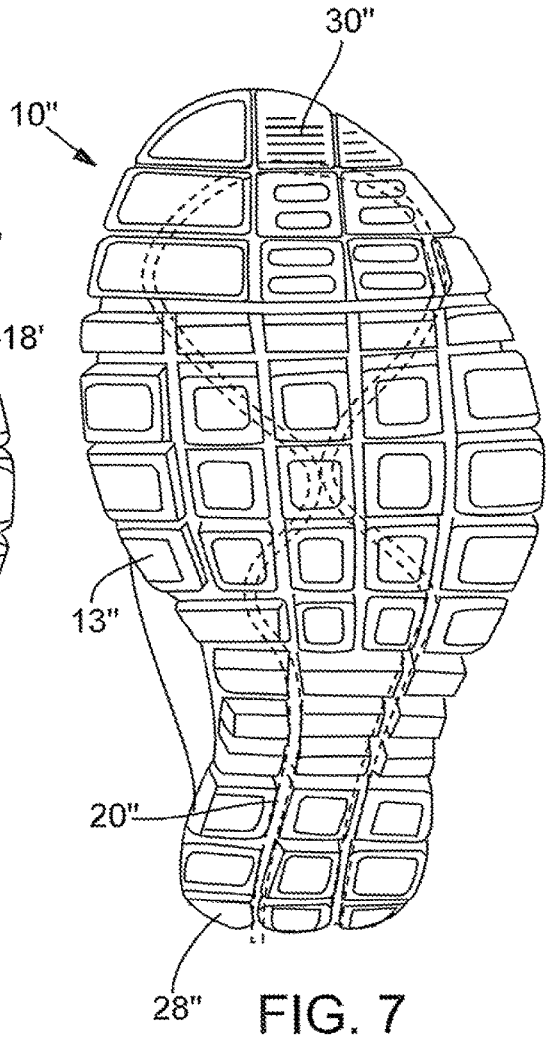

Furthermore, as shown in the embodiment of FIG. 7, the biasing structure 20" can extend from the posterior portion 28" to the anterior portion 30" of the footwear 10", and the biasing structure 20" can also have an hourglass-type curvature adjacent the anterior portion 30". Thus, by adjusting the biasing structure 20" as discussed above, the biasing structure 20" can bias medial and lateral sides of the sole assembly 13" toward each other. Also, by adjusting the biasing structure 20" in an opposite direction, the sole assembly 13" can be less stiff in the medial/lateral direction.

Figure 8:
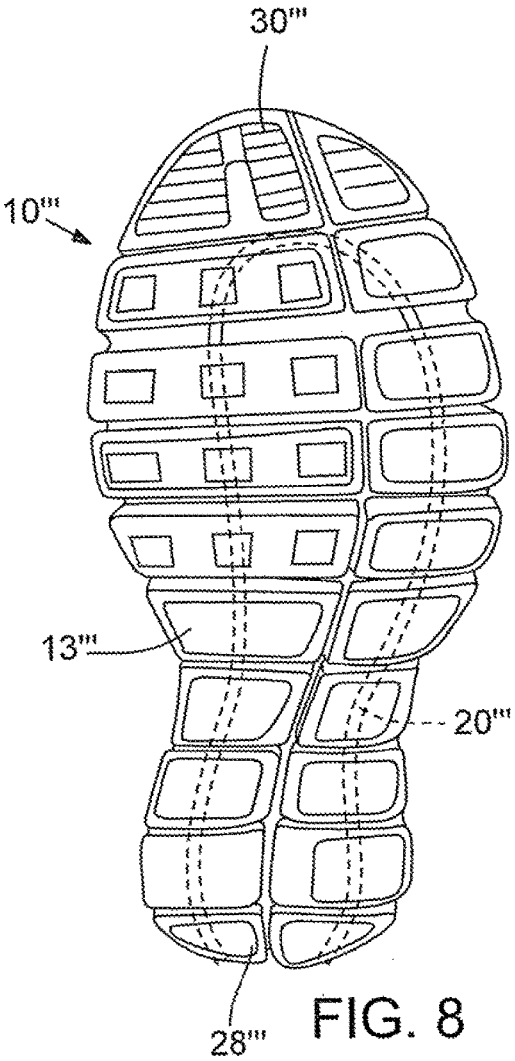

In addition, as shown in the embodiment of FIG. 8, the biasing structure 20''' can extend from the posterior portion 28''' toward the anterior portion 30''' and back again. Also, the curved axis of the biasing structure 20''' can correspond substantially to the curvature of the outer periphery of the sole assembly 13''' .

Figure 9:
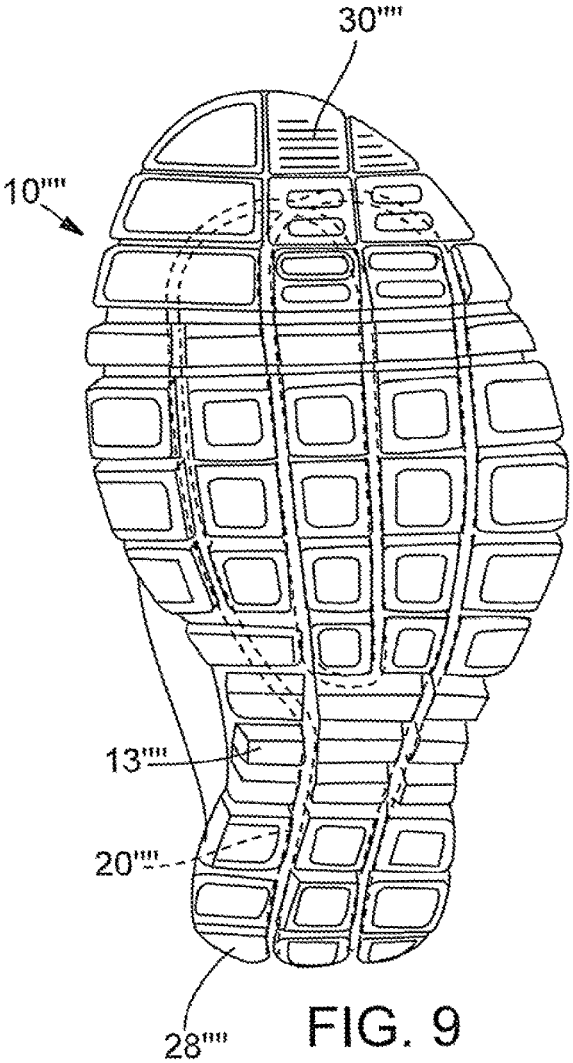

Moreover, as shown in the embodiment of FIG. 9, the biasing structure 20'''' can extend from the posterior portion 28'''', toward the anterior portion 30'''', back toward the posterior portion 28'''', then back toward the anterior portion 30'''', loop over itself, and curve back toward the posterior portion 28''''. Because the biasing structure 20'''' is located substantially in the anterior portion 30'''' 1 and loops over itself in the anterior portion 30'''', the biasing structure 20'''' can adjust stiffness primarily in the anterior portion 30'''' of the footwear 10''''.

Still further, as shown in the embodiment of FIG. 10, the biasing structure 20'''' can extend primarily in a medial-lateral direction. More specifically, the biasing structure 20'''' can extend from the medial forefoot area, toward the lateral forefoot area, and can loop back toward the medial forefoot area. The biasing structure 20'''' can be substantially perpendicular to the axis X of the footwear 10''''. Also, the biasing structure 20'''' can include a first end 22'''' and a second end 24'''' that each extend out of the sole assembly 13'''' to be operatively coupled to an adjustment device 32'''' of the type discussed above. As shown, the adjustment device 32'''' can be operatively coupled to the external, medial forefoot area of the sole assembly 13'''' . By adjusting the adjustment device 32'''', the biasing structure 20 can be used to change the stiffness under the ball of the wearer's foot, primarily in the medial-lateral direction. It will also be appreciated that the sole assembly in the embodiment shown does not include grooves of the type discussed above; however, it will be appreciated that the sole assembly 13'''' can include grooves without departing from the scope of the present disclosure.

Accordingly, the wearer can selectively adjust the flexibility of the sole assembly 13. Thus, the article of footwear 10 can be more versatile for use in a wider range of activities, and adequate comfort can be maintained. Also, the flexibility of the sole assembly 13 can be adjusted to compensate for wear.

It will be appreciated that the article of footwear 10 can be modified in various ways. For instance, in some embodiments, the footwear 10 includes a plurality of passages 29, and the wearer can choose which passage 29 to thread the biasing structure 20 through. Accordingly, the wearer can select the area of the sole assembly 13 to be biased by the biasing structure 20. Furthermore, in some embodiments, the wearer can select from different biasing structures 20. For instance, the footwear 10 can be part of a kit that includes a plurality of biasing structures 20, each with a different spring constant. As such, the wearer can select one of the biasing structures 20 to thread into the sole assembly 13 in order to obtain a desired amount of biasing supplied from the biasing structure 20 on the sole assembly 13. Moreover, in some embodiments, the footwear 10 can include a plurality of biasing structures 20, each with a respective adjustment device 32.

In addition, in some embodiments, the adjustment device 32 can be configured for automatically adjusting the amount of stiffness (e.g., with the touch of a single button). Moreover, in some embodiments, the adjustment device 32 can be set digitally by the user (e.g., by typing a present amount of stiffness into a keypad).

Referring now to FIG. 12, a portion of another exemplary embodiment of the article of footwear 110 is illustrated. Components that are similar to the embodiments of FIGS. 1-4 are indicated by corresponding reference numerals increased by 100.

As shown, the biasing structure 120 can extend across a groove 118 within the sole assembly 113 similar to the embodiments discussed above. Furthermore, the biasing structure 120 can be received within reinforcing tubes 140*a*, 140*b*, which are each fixed within the sole assembly 113 (e.g., embedded within the midsole 116). More specifically, the tube 140*a* can be fixed to a first portion 119*a* of the sole assembly 113, and the tube 140*b* can be fixed to a second portion 119*b* of the sole assembly 113.

The reinforcing tube 140*a* can include a projected end 147, and the reinforcing tube 140*b* can include a recessed end 149. The projected end 147 can have a curvature that substantially conforms to a curvature of the recesses end 149. As such, the projected end 147 can be received and can fit within the recessed end 149, for instance if the groove 118 is closed. Thus, if the biasing structure 120 pulls the portions 119*a*, 119*b* together or if the natural flexure of the sole assembly 113 causes the groove 118 to close, then the ends 147, 149 can fit together. Moreover, if the portions 119*a*, 119*b* rotate toward each other, and the ends 147, 149 are slightly misaligned, the recessed end 149 can guide the projected end 147 to fit within the recessed end 149 because the ends 147, 149 each have a corresponding curvature. Thus, when the ends 147, 149 fit together, the reinforcing tubes 140*a*, 140*b* can provide additional structural rigidity to the sole assembly 113 for added stiffness, for added comfort for the wearer, for increased wear resistance, etc.

In addition, both reinforcing tubes 140*a*, 140*b* can each include anchoring projections 151. Each anchoring projection 151 can be a thin, elongate, rigid member that extends transversely (e.g., perpendicularly) away from the axis of the respective reinforcing tube 140*a*, 140*b*. In some embodiments, each reinforcing tube 140*a*, 140*b* can include a plurality (e.g., two) anchoring projections 151 that extend therefrom. Also, in some embodiments, the anchoring projection 151 can be integrally connected to its respective reinforcing tube 140*a*, 140*b*. The anchoring projection 151 can be fixed to (e.g., embedded via a molding process) to the midsole 116 or other portion of the sole assembly 113. The anchoring projection 151 can distribute loads from the respective reinforcing tube 140*a*, 140*b* to the sole assembly 113. Accordingly, the sole assembly 113 is less likely to be damaged due to stress concentrations.

Figure 13:
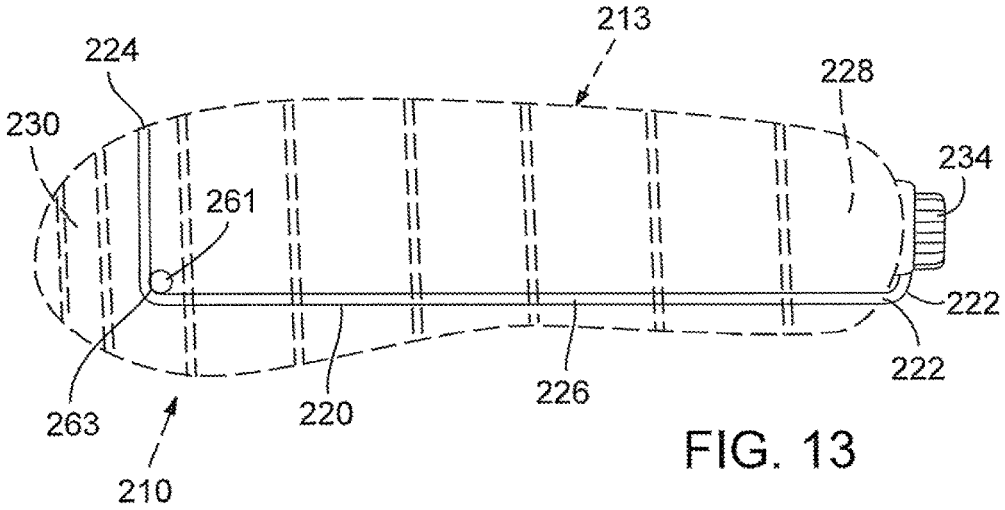
FIG. 13 is a bottom view of the article of footwear according to another exemplary embodiment of the present disclosure.

Referring now to FIG. 13, another exemplary embodiment of an article of footwear 210 is illustrated. Components that are similar to the embodiments of FIGS. 1-4 are indicated by corresponding reference numerals increased by 200.

The article of footwear 210 can include a biasing structure 220 with a first end 222, a second end 224, and a middle portion 226. The first end 222 can be operably coupled to an adjustment device 234 adjacent the posterior portion 228 of the footwear 210, and the second end 224 of the biasing structure 220 can be operably coupled (e.g., fixed) to the sole assembly 213 adjacent the anterior portion 230. The second end 224 can extend partially out of the sole assembly 213 and can be fixed on an outer surface of the sole assembly 213, or the second end 224 can be embedded within the sole assembly 213 adjacent the outer surface of the sole assembly 213. Furthermore, the middle portion 226 can extend generally parallel to the axis X along the posterior portion 228, and the middle portion 226 can extend transversely (i.e., laterally) away from the axis X. Thus, the flexibility of the sole assembly 213 can be adjusted along the axis X of the footwear 210 and in the medial-lateral direction under the ball of the wearer's foot.

In some embodiments, the footwear 210 can include a stake 261. The stake 261 can be a substantially rigid member and can include at least one rounded surface 263. The stake 261 can be fixed to (e.g., embedded via a molding process) to the sole assembly 213. The biasing structure 220 can abut against the rounded surface 263 and can wrap partially around the stake 261.

It will be appreciated that the article of footwear 210 can include a plurality of stakes 261, and the stakes 261 can be disposed at any suitable location on the footwear 210. Accordingly, the stake(s) 261 can provide a convenient means for routing the biasing structure 220 within the footwear 210.

Figure 14:
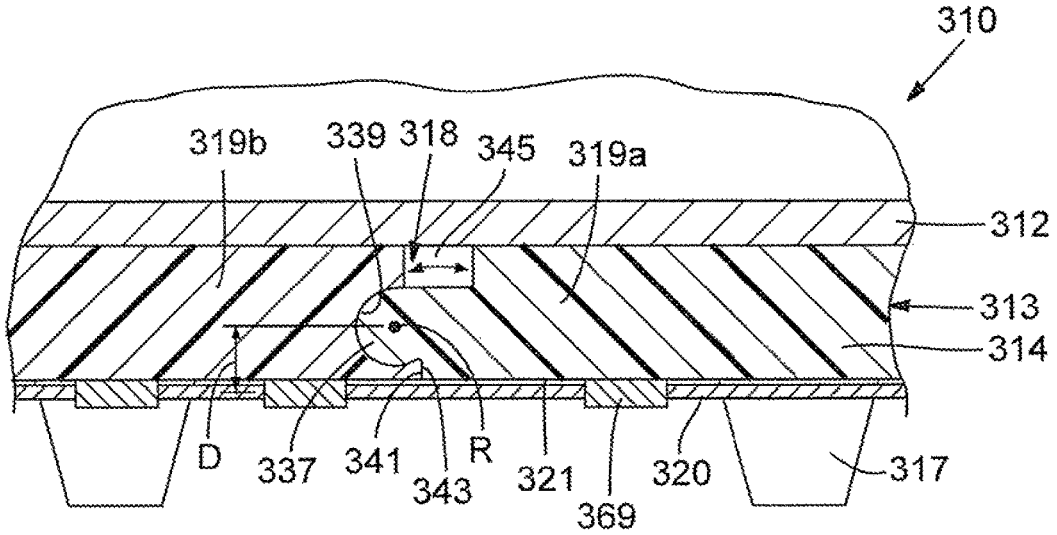
FIG. 14 is a cross sectional view of a portion of the article of footwear according to another exemplary embodiment of the present disclosure.

Referring now to FIG. 14, another exemplary embodiment of an article of footwear 310 is illustrated. Components that are similar to the embodiments of FIGS. 1-4 are indicated by corresponding reference numerals increased by 300.

As shown, the article of footwear 310 can include an upper 312 and a sole assembly 313. The sole assembly 313 can include an outsole 314. The outsole 314 can be directly coupled to the upper 312. In other embodiments, the sole assembly 313 can include a midsole disposed between the outsole 314 and the upper 312.

In some embodiments, the outsole 314 can be relatively rigid. For instance, the outsole 314 can be made out of relatively hard rubber or other polymeric material, which resists compression under normal loading and yet allows for some degree of flexure along the longitudinal axis of the footwear 310. Accordingly, the outsole 314 can be very durable and robust without significantly reducing comfort or mobility for the wearer.

The outsole 314 can include one or more cleats 317 extending from a lower, outer surface 321 thereof. The cleats 317 can be of any suitable type and can increase traction of the footwear 310. Also, the cleats 317 can be removably attached or integrally attached to the outsole 314. Thus, the footwear 310 can be used for various activities, such as playing football, soccer, baseball, etc.

Also, the outsole 314 can be separated into first and second portions 319*a*, 319*b* by a groove 318. As shown, the groove 318 can extend non-linearly in the thickness direction of the outsole 314. Furthermore, the groove 318 can extend through the entire thickness of the outsole 314. In other embodiments, the groove 318 can extend only partially through the thickness of the outsole 314.

More specifically, the first portion 319*a* can include a projection 337, and the second portion 319*b* can include a recess 339 that receives the projection 337. The projection 337 can have a two- or three-dimensional curvature (e.g., hemispherical curvature), and the recess 339 can have a corresponding curvature, thereby allowing the projection 337 to rotate within the recess 339. For instance, the projection 337 can rotate about an axis of rotation R as indicated by the double-headed arrow in FIG. 14.

Furthermore, the first portion 319*a* can include an abutment surface 341, and the second portion 319*b* can include an abutment surface 343. The abutment surfaces 341, 343 can be disposed adjacent each other, underneath the projection 337 and recess 339, respectively. The abutment surfaces 341, 343 can abut against each other to limit rotation of the first portion 319*a* relative to the second portion 319*b*. Specifically, such abutment can limit rotation of the first portion 319*a* in a clockwise direction in FIG. 14 and can limit rotation of the second portion 319*b* in a counter-clockwise direction in FIG. 14.

Additionally, the groove 318 can be significantly wider on a side of the projection 337 that is opposite the abutment surfaces 341, 343. As such, a gap 345 can be defined, which allows for increased rotation of the first portion 319*a* relative to the second portion 319*b* as will be discussed. Specifically, the gap 345 can allow for increased rotation of the first portion 319*a* in the counter-clockwise direction in FIG. 14 and can allow for increased rotation of the second portion 319*b* in the clockwise direction in FIG. 14.

Furthermore, the footwear 310 can include a biasing structure 320. The biasing structure 320 can be a rigid, non-extendable cord similar to the embodiments discussed above. In other embodiments, the biasing structure 320 can be at least partially resilient and extendable.

The biasing structure 320 can be operably coupled directly to the lower, outer surface 321 of the outsole 314.

The biasing structure 320 can extend across the groove 318 and can be operably coupled to both the first and second portions 319*a*, 319*b* of the outsole 314. For instance, the biasing structure 320 can be coupled to the outsole 314 via one or more removably attached fasteners 369. The fasteners 369 can each be U-shaped and can be removably attached to the lower, outer surface 321 at both ends such that the biasing structure 320 is retained between the fastener 369 and the lower, outer surface 321. In other embodiments, the fasteners 369 can be integrally connected to the outsole 314 so as to be monolithic. In some embodiments, the fasteners 369 can slideably receive the biasing structure 320, and in other embodiments, the fasteners 369 can be fixed to the biasing structure 320.

It will be appreciated that the biasing structure 320 can be operably coupled to the outsole 314 in any suitable fashion other than the fasteners 369 without departing from the scope of the present disclosure. Moreover, it will be appreciated that the biasing structure 320 can be operably coupled to the outsole 314 in any suitable location. For instance, the biasing structure 320 can be disposed on a side of the outsole 314 opposite to the lower, outer surface 321 (i.e., adjacent the upper, outer surface of the outsole 314). In other embodiments, the biasing structure 320 can extend through a passageway within the outsole 314 to be contained by the outsole 314 similar to the embodiments of FIGS. 1-4 and discussed above.

Depending on the tension within the biasing structure 320, the first and second portions 319*a*, 319*b* can move relative to each other (e.g., rotate about the axis of rotation R). In some embodiments, tension in the biasing structure 320 can be adjusted as discussed above with respect to the embodiments of FIGS. 1-4. Thus, if the tension in the biasing structure 320 is reduced, the first and second portions 319*a*, 319*b* can rotate or otherwise move relative to each other more easily. Furthermore, if the tension in the biasing structure 320 is increased, the biasing structure 320 can bias the first and second portions 319*a*, 319*b* toward each other, and movement of the first and second portions 319*a*, 319*b* relative to each other is restricted. This is because the increased tension in the biasing structure 320 increases friction between the projection 337 and the recess 339. In some embodiments, the tension in the biasing structure 320 can be high enough such that the first and second portions 319*a*, 319*b* (and any other portions of the outsole 314) are substantially locked together such that the outsole 314 reacts relatively uniformly to outside forces, similar to a one-piece, unitary outsole 314. If desired, the tension in the biasing structure 320 can be reduced to unlock the portions 319*a*, 319*b* of the outsole 314 (e.g., to allow rotation or other movement of the forefoot portion relative to the heel portion).

Also, as shown in FIG. 14, because the biasing member 320 is separated from the axis of rotation R at the distance D, the abutment surfaces 341, 343 can be readily biased toward each other. As such, movement of the first and second portions 319*a*, 319*b* relative to each other can be controlled. In addition, the distance D is a lever arm that can provide mechanical advantage to the biasing structure 320 such that less tension is needed in the biasing structure 320 to produce friction between the first and second portions 319*a*, 319*b*.

In addition, it will be appreciated that because the biasing structure 320 is coupled to the outer surface 321 of the outsole 314, the footwear 310 can be manufactured efficiently. For instance, the outsole 314 can be manufactured in a highly-reproduceable and inexpensive manner (e.g., molding). Once the outsole 314 has been formed, the biasing structure 320 can be coupled to the outsole 314 using the fasteners 369.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

What is claimed is:

1. A sole assembly for an article of footwear, the sole assembly comprising:

a midsole including at least one groove having a longitudinal axis that extends between a medial side of the midsole and a lateral side of the midsole, the at least one groove separating the midsole into distinct portions; and a biasing structure having a first portion crossing the at least one groove and extending along a longitudinal axis of the midsole proximate to the medial side and a second portion crossing the at least one groove and extending along the longitudinal axis of the midsole proximate to the lateral side, the first portion including a first arcuate segment that extends away from the medial side toward the lateral side and the second portion including a second arcuate segment that extends away from the lateral side toward the medial side, is aligned with the first arcuate segment in a direction extending between the medial side and the lateral side, and crosses the first portion.

2. The sole assembly of claim 1, wherein the first arcuate segment contacts the second portion at the second arcuate segment.

3. The sole assembly of claim 1, wherein the first arcuate segment contacts the second arcuate segment proximate to a forefoot region of the midsole.

4. The sole assembly of claim 1, wherein the biasing structure is a cord extending continuously from a first end to a second end, the first portion and the second portion being disposed along a length of the biasing structure between the first end and the second end.

5. The sole assembly of claim 4, wherein the biasing structure includes a connecting segment extending between and joining the first portion and the second portion, the connecting segment disposed within a forefoot region of the midsole.

6. The sole assembly of claim 5, wherein the connecting segment includes an arcuate shape.

7. The sole assembly of claim 4, wherein the first end and the second end extend from the midsole and are operatively connected to an adjustment device.

8. The sole assembly of claim 7, wherein the adjustment device is operable to selectively reduce an effective length of the biasing structure to reduce a size of the at least one groove.

9. The sole assembly of claim 7, wherein the adjustment device is operable to selectively increase an effective length of the biasing structure to increase a size of the at least one groove.

10. A sole assembly for an article of footwear, the sole assembly comprising:

a midsole including at least one groove having a longitudinal axis that extends between a medial side of the midsole and a lateral side of the midsole, the at least one groove separating the midsole into distinct portions; and a biasing structure having a first portion crossing the at least one groove and extending continuously along a longitudinal axis of the midsole from a heel region to a forefoot region of the sole assembly and a second portion crossing the at least one groove and extending continuously along the longitudinal axis of the midsole from the heel region to the forefoot region of the sole assembly, the first portion including a first segment that extends away from the medial side toward the lateral side and the second portion including a second segment that extends away from the lateral side toward the medial side, contacts the first segment at a contact location, and crosses the first portion at the contact location.

11. The sole assembly of claim 10, wherein a portion of at least one of the first segment and the second segment is arcuate.

12. The sole assembly of claim 10, wherein the contact location is disposed within the forefoot region of the midsole.

13. The sole assembly of claim 10, wherein the biasing structure is a cord extending continuously from a first end to a second end, the first portion and the second portion being disposed along a length of the biasing structure between the first end and the second end.

14. The sole assembly of claim 13, wherein the biasing structure includes a connecting segment extending between and joining the first portion and the second portion, the connecting segment disposed within a forefoot region of the midsole.

15. The sole assembly of claim 14, wherein the connecting segment includes an arcuate shape.

16. The sole assembly of claim 13, wherein the first end and the second end extend from the midsole and are operatively connected to an adjustment device.

17. The sole assembly of claim 16, wherein the adjustment device is operable to selectively reduce an effective length of the biasing structure to reduce a size of the at least one groove.

18. The sole assembly of claim 16, wherein the adjustment device is operable to selectively increase an effective length of the biasing structure to increase a size of the at least one groove.

* * * * *